US008146269B2

(12) United States Patent
Mueller

(10) Patent No.: US 8,146,269 B2
(45) Date of Patent: Apr. 3, 2012

(54) DIAGONALLY TWISTED SOLE

(75) Inventor: Jung-Suk Mueller, Roggwil (CH)

(73) Assignee: Negort AG, Roggwil (CH)

( * ) Notice: Subject to any disclaimer, the term of this patent is extended or adjusted under 35 U.S.C. 154(b) by 946 days.

(21) Appl. No.: 10/585,777

(22) PCT Filed: Jan. 10, 2005

(86) PCT No.: PCT/IB2005/050103
§ 371 (c)(1),
(2), (4) Date: Jun. 12, 2008

(87) PCT Pub. No.: WO2005/067754
PCT Pub. Date: Jul. 28, 2005

(65) Prior Publication Data

US 2008/0229624 A1 Sep. 25, 2008

(30) Foreign Application Priority Data

Jan. 13, 2004 (CH) ..... 00044/04

(51) Int. Cl.
*A43B 7/22* (2006.01)
*A43B 7/24* (2006.01)
*A43B 13/14* (2006.01)
*A43B 13/12* (2006.01)

(52) U.S. Cl. ..... 36/25 R; 36/30 R; 36/144

(58) Field of Classification Search ..... 36/25 R, 36/30 R, 31, 142, 143, 144
See application file for complete search history.

(56) References Cited

U.S. PATENT DOCUMENTS 2,097,759 A 11/1937 Ehrlich
3,330,178 A 7/1967 Timson
3,550,597 A * 12/1970 Waddington ..... 36/144
4,572,355 A 2/1986 Hunter
4,620,376 A 11/1986 Talarico, II
4,854,057 A * 8/1989 Misevich et al. ..... 36/114
4,890,397 A * 1/1990 Harada et al. ..... 36/30 R
5,052,130 A * 10/1991 Barry et al. ..... 36/107
5,179,791 A * 1/1993 Lain ..... 36/27
5,448,839 A * 9/1995 Blissett et al. ..... 36/25 R
5,632,104 A * 5/1997 Zohar ..... 36/88
6,782,639 B1 * 8/2004 Muller ..... 36/28
6,848,896 B2 2/2005 Effenberger
7,464,428 B2 * 12/2008 Norton ..... 12/146 B (Continued)

FOREIGN PATENT DOCUMENTS

DE 33 30 178 A1 3/1985

(Continued)

OTHER PUBLICATIONS

European Search Report based on European Patent No. 08 00 1037; Date of Mailing; Jun. 26, 2008.

(Continued)

*Primary Examiner* — Marie Patterson
(74) *Attorney, Agent, or Firm* — Marshall, Gerstein & Borun LLP

(57) ABSTRACT

A diagonally twisted sole may include an undersole and a midsole bottom, the midsole bottom being connected to the undersole, and various hard inserts being able to be introduced into the undersole. Together with a twisted, flexible, rigid or elastic plate, the undersole can form a midsole, which may include several parts. The twisted plate may be a flat plate or a plate of different thicknesses.

12 Claims, 3 Drawing Sheets

U.S. PATENT DOCUMENTS

| | | | | |
|---|---|---|---|---|
| 2002/0005000 | A1 | 1/2002 | Choi | |
| 2002/0139011 | A1 | 10/2002 | Kerrigan | |
| 2005/0091881 | A1 * | 5/2005 | Burgess | 36/30 R |
| 2009/0307925 | A1 * | 12/2009 | Pfister | 36/28 |

FOREIGN PATENT DOCUMENTS

| | | | |
|---|---|---|---|
| DE | 100 00 207 | A1 | 7/2001 |
| DE | 10154325 | | 5/2003 |
| EP | 0265713 | | 5/1988 |
| FR | 27200679 | | 12/1995 |
| WO | WO 01/15560 | A1 | 3/2001 |

OTHER PUBLICATIONS

International Preliminary Report on Patentability corresponding to International Patent Application Serial No. PCT/IB2005/050103, International Bureau of WIPO, dated Jan. 13, 2004, 5 pages.

International Search Report in PCT/IB2005/050103 dated May 9, 2005.

* cited by examiner 1
2
10
12
13
16
H
α
β
Z
A 1
2
10
12
13
16
H
Z
A

DIAGONALLY TWISTED SOLE

CROSS REFERENCE TO RELATED APPLICATION

This is the U.S. National Phase of PCT/IB2005/050103 filed Jan. 10, 2005, that claims priority from Swiss patent application CH 00044/04, filed Jan. 13, 2004, the entire disclosure both of which are incorporated herein by reference.

The present invention relates to a diagonally twisted sole according to the preamble of patent claim 1.

Patent number WO 01/15560 A1 states the following: "The human being with his highly complicated ligament-muscle-tendon system and the sensitive, upright spinal column is built so that in nature he can advance on uneven ground. For thousands of years the human being has used and maintained his body in accordance with this natural condition." In said patent application, the shape and configuration of the midsole and of the sole of the shoe are described in detail. Studies have been carried out on the described inserts in the sole. The results and conclusions of these studies have led to the present patent application.

Tests and observations show that a natural walking movement follows more or less the following sequence. When the heel is placed on the ground, the foot rests on the outer edge of the heel. The foot then rolls inwards at an angle to the direction of walking, until pushing off again from the ball of the foot and big toe oriented towards the centre between the two feet. The load placed on the sole of the foot moves across the diagonal thereof. From the heel, which is loaded outside, the line of loading moves diagonally inwards across the sole of the foot all the way to the ball of the foot and the big toe.

This is so is also confirmed by the footprint of a healthy person. A child's footprint is still often correct since the heel, the outer edge of the foot and the whole ball of the foot together with the toes can be seen in a footprint, but not the area below the instep. Older people often have other footprints that result from incorrect posture and incorrect heel-to-toe movement of the feet.

In a civilized population, accustomed for generations to wearing shoes from early childhood, a deformation of the feet can be seen from the following feature: The big toe is directed outwards away from the centre line between the two feet. It is also known that, in primitive tribes, the big toe is always oriented towards the centerline between the two feet. The reason for this must be that the big toe, in this position, is better able to support the ball of the foot when pushing off.

This twisting of the load exerted on the foot is not found in the population of civilized societies accustomed to shoes and to hard and flat surfaces. When walking on flat surfaces, the flat sole forces the foot into a straight heel-to-toe movement. The lateral load changes and the rolling movement in the lateral direction becomes negligible over time. This false rolling movement has to be compensated by knee joints and hip joints and also by the spinal column, and this in turn has the consequence that the whole system of locomotion is incorrectly loaded because of the incomplete rolling of the feet. As a result of this, our society suffers from all kinds of posture-related conditions with painful arthrosis and problems of the spinal column.

The present invention now has the object of correcting the incorrect placement of the heel and incorrect heel-to-toe movement during walking in such a way that the natural rolling movement with a diagonal load curve of the soles of the feet is gently enforced and the natural and dynamic movements and loads of the knee joints and hip joints and of the spinal column are gently enforced during walking.

This object is achieved by a diagonally twisted sole with the features of patent claim 1. Further features according to the invention are set forth in the dependent claims, and their advantages are explained in the description below.

Figures 12, 13, 14, 15, 16, 17, 18, 19:
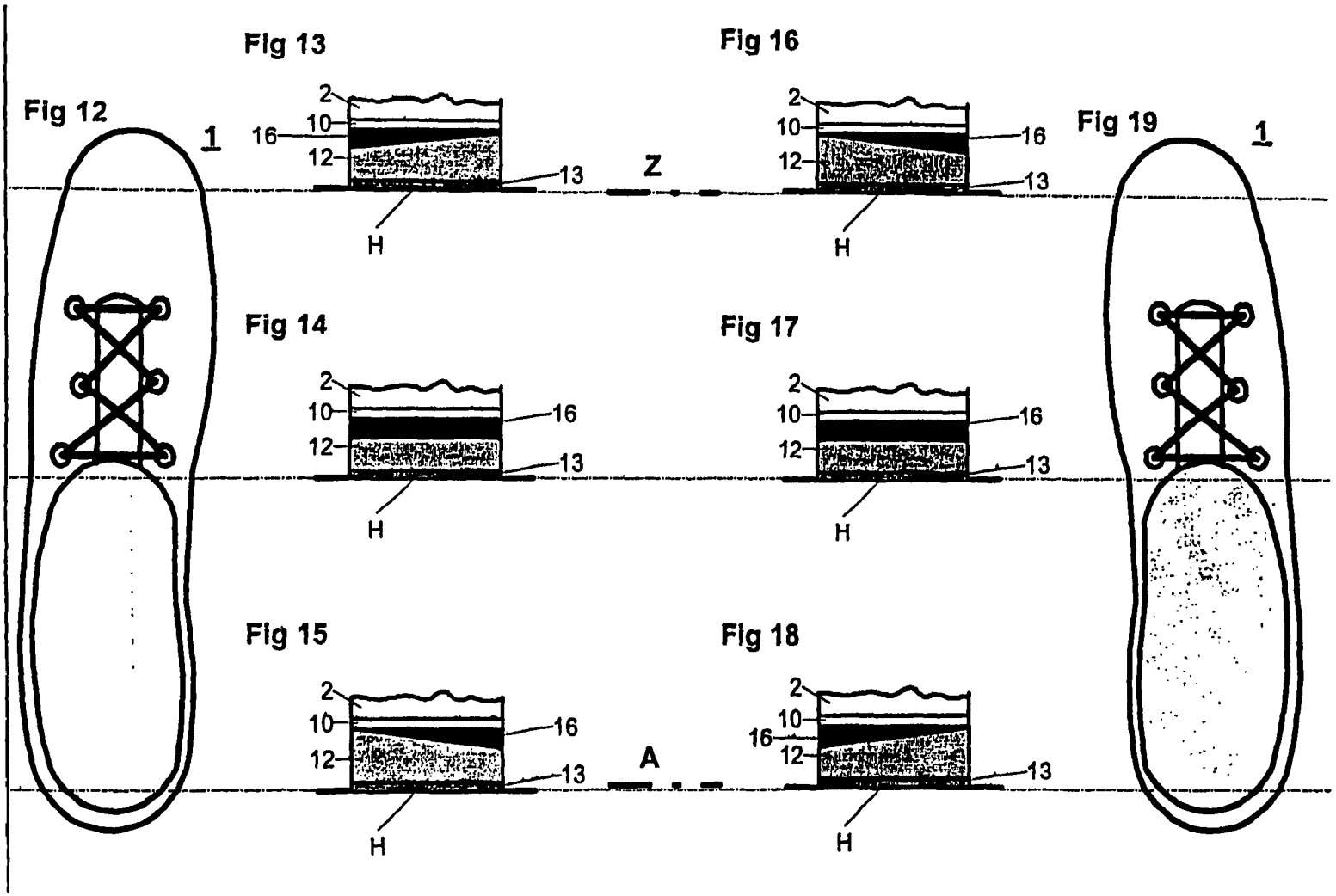
FIG. 12 shows the left shoe.

FIG. 13 shows a cross section through the toe part of the left shoe, the twisted plate and hard inclusion, FIG. 14 shows a cross section in the middle third of the left shoe, the twisted plate and hard inclusion, FIG. 15 shows a cross section through the heel part of the left shoe, the twisted plate and hard inclusion, FIG. 16 shows a cross section through the toe part of the right shoe, the twisted plate and hard inclusion, FIG. 17 shows a cross section in the middle third of the right shoe, the twisted plate and hard inclusion, FIG. 18 shows a cross section through the heel part of the right shoe, the twisted plate and hard inclusion, and FIG. 19 shows the right shoe.

The drawings show preferred embodiments illustrated by the following description.

Patent specification WO 01/15560 A1 describes (FIG. 1) how various types of loading of the foot can be achieved by means of hard inserts 15 in the undersole 12. The main focus there was on specific therapeutic measures that could be achieved with this type of sole 3 and shoe 1. It has now been found that what was described in the above introduction holds true in general terms: Particularly in persons suffering from pain in the knees, hips or back, the line of loading of the foot no longer runs diagonally across the foot during walking. One "treads" forward, so to speak, and in so doing places a weight on the foot with a line of loading that runs in the direction of walking. As a result, knee joints and hip joints are always loaded at the same points. The completely dynamic movement during walking is absent. This leads to painful attrition and in many cases to arthrosis.

Figure 1:
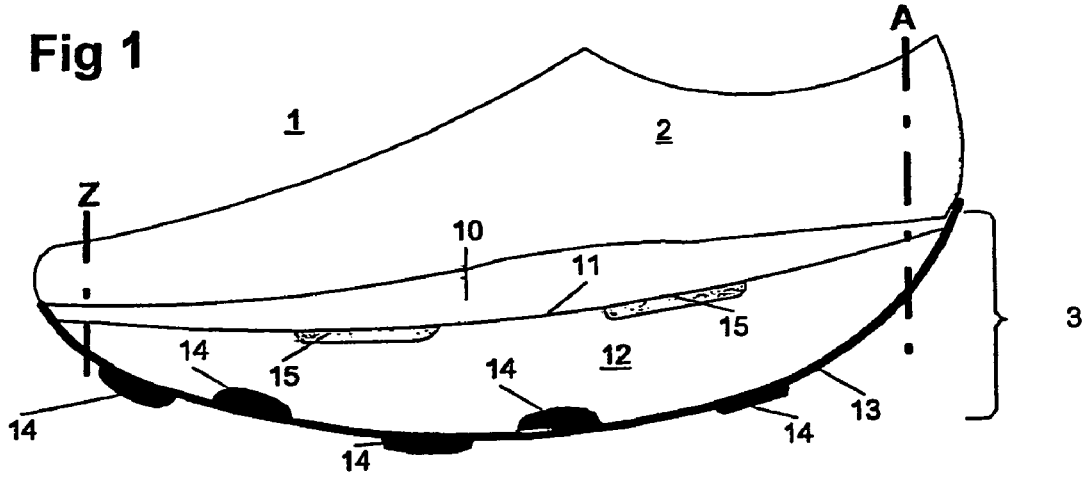
FIG. 1 shows the structure of a shoe.

The shoe 1 depicted in FIG. 1, or the sole 3 thereof, already allows the desired line of loading to be adopted by means of arranging different types of inserts 15 of differing hardness on the midsole bottom 11. This possibility is made possible by the undersole 12 having a sand-like elasticity. By this measure alone, therefore, a diagonal or freely definable form of the line of loading can be established.

Figure 2:
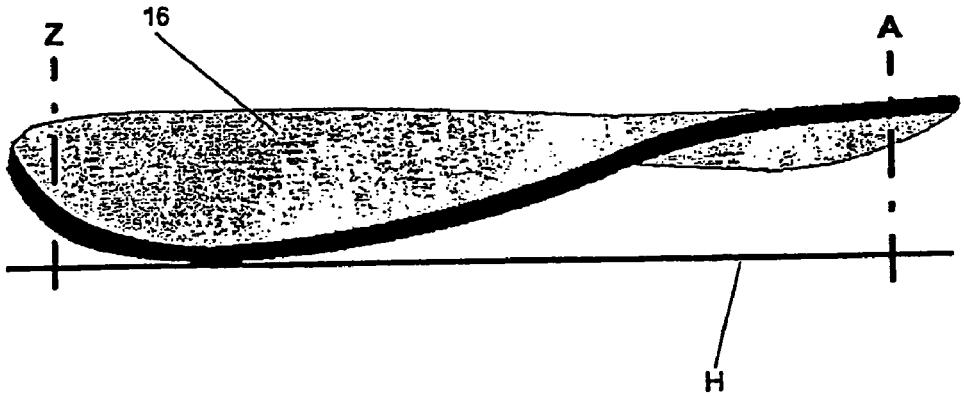
FIG. 2 shows a theoretical side view of a diagonally twisted sole.
Figure 3:
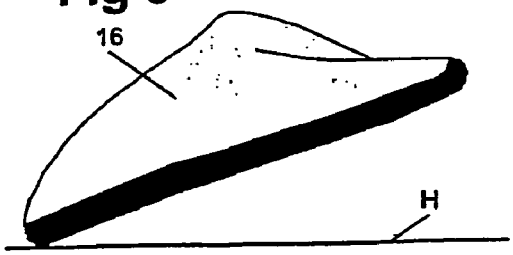
FIG. 3 shows a theoretical front view of a diagonally twisted sole.
Figures 4, 5, 6, 7, 8, 9, 10, 11:
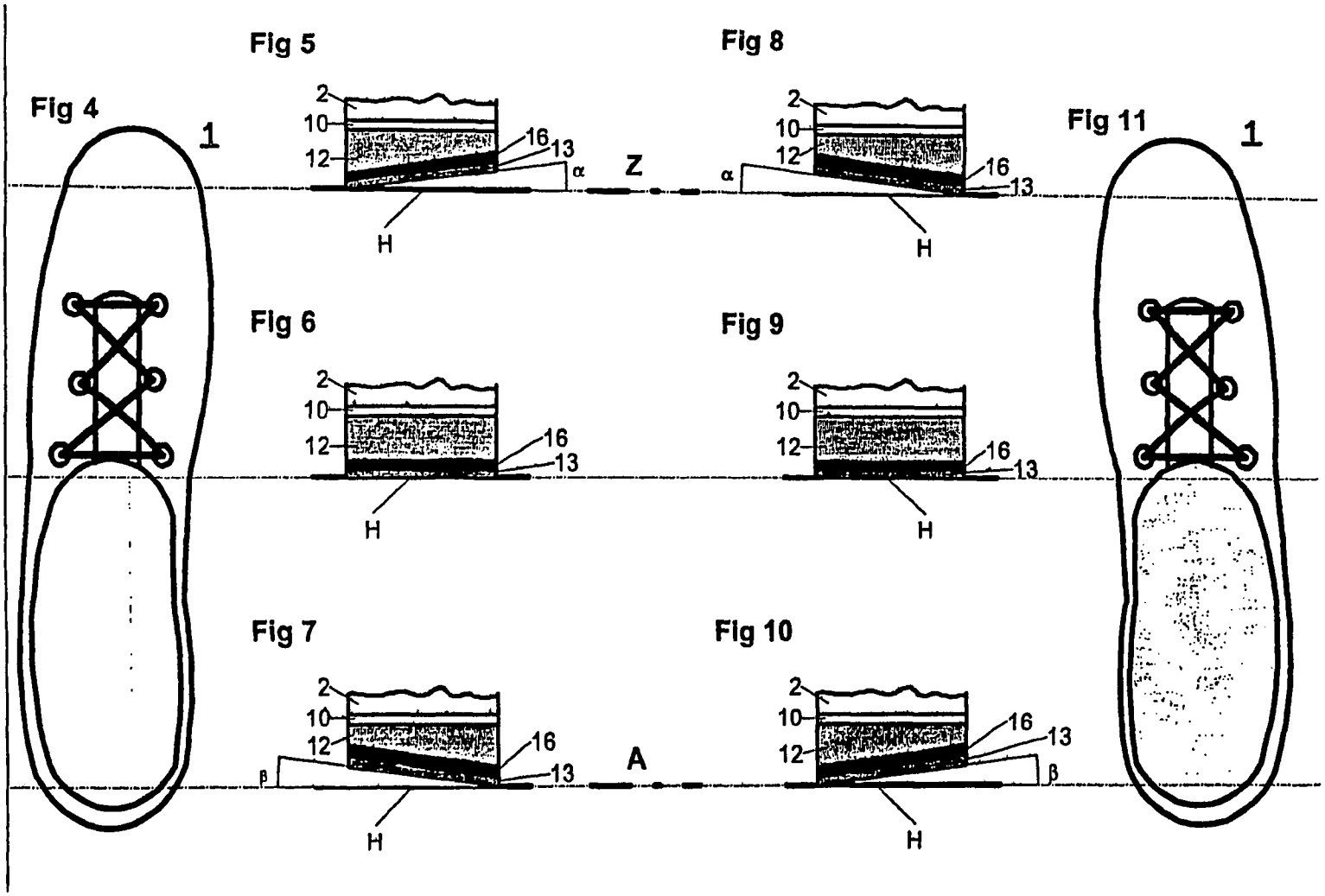
FIG. 4 shows a left shoe.
FIG. 5 shows a cross section through the toe part of the left shoe.
FIG. 6 shows a cross section in the middle third of the left shoe.
FIG. 7 shows a cross section through the heel part of the left shoe.
FIG. 8 shows a cross section through the toe part of a right shoe.
FIG. 9 shows a cross section in the middle third of the right shoe.
FIG. 10 shows a cross section through the heel part of the right shoe.
FIG. 11 shows the right shoe.

It has now been shown that the undersole 12 is advantageously formed against the sole bottom 13 such that the latter assumes the diagonally twisted form depicted theoretically in FIG. 2 and FIG. 3. In these views, the twisting is very distinct, in order to illustrate the concept of the invention. In practice, the twisting, indicated by angle α in the toe area Z and designated by angle β in the heel area A, with respect to the horizontal H will amount to a few degrees. Moreover, the twisting of the sole bottom 13 is always adapted to the requirements of the patient and freely configured. In special cases, it is conceivable for it not to be systematically twisted, but instead to be adapted to a deformity, incorrect position or impediment of the foot.

For aesthetic reasons, it will be sought to keep the outward appearance of the shoe as normal as possible. The above-described configuration does not permit this, and, instead, the shoe is very unstable on a surface and is clearly different in appearance from a normal shoe. FIG. 12 to FIG. 19 show how the same effect can be achieved if a twisted plate 16 is built into the soft undersole 12 instead of individual hard inserts 15. The sole bottom 13 will then be parallel with the horizontal H, as is shown in FIG. 13 to FIG. 18. This twisted plate 16 will be hard and will either be completely stiff or elastically flexible and will be connected to the midsole bottom 11. The space between the midsole bottom 11 and sole bottom 13 is filled by the combination of the twisted plate 16 and the undersole 12 of sand-like elasticity. The twisted plate 16 and the undersole 12 together form a resilient intermediate sole 12, 16.

The twisted plate can be shaped in different ways. If the planes of the midsole bottom 11 and of the sole bottom 13 transverse to the walking direction are parallel, the twisted plate, as shown in FIGS. 13, 15, 16 and 18, will have different thicknesses across its surface. The resilient intermediate sole 12, 16 is then harder at places of great thickness of the twisted plate 16 (e.g. FIG. 16, right) and softer at thin places thereof (e.g. FIG. 16, left).

The flat twisted plate 16, as shown in FIGS. 2 and 3, is either connected to the sole bottom 13, as is shown for example in FIGS. 5, 6, 7, 8, 9, 10, or it is connected to the midsole bottom 11, which then assumes the form of the twisted plate 16.

With the present invention, it is possible to help patients suffering from a wide variety of posture-related problems, by providing them with shoes which are adapted to the condition from which they are suffering and which are designed for daily use. The major advantage of this is that the patients do not have to perform any exercises or special gymnastics, but instead are treated by wearing these shoes on a daily basis.

What is claimed is:

1. Diagonally twisted sole comprising a soft undersole and a midsole with a midsole bottom, the midsole bottom being connected to the soft undersole, and the soft undersole being closed off by a hard and abrasion-resistant sole bottom, wherein a twisted plate is built into the sole and forms, together with the undersole, an intermediate sole.

2. Diagonally twisted sole according to claim 1, wherein the intermediate sole comprises several parts.

3. Diagonally twisted sole according to claim 1, wherein the twisted plate is connected to the sole bottom, such that the sole bottom has the same twisted form as the twisted plate.

4. Diagonally twisted sole according to claim 1, wherein the twisted plate is connected to the midsole bottom, such that the midsole bottom has the same twisted form as the twisted plate.

5. Diagonally twisted sole according to claim 1, wherein the twisted plate has different thicknesses at different places.

6. Diagonally twisted sole according to claim 1, wherein, in a heel area of the sole, between the midsole bottom and the sole bottom, the undersole forms, transverse to the walking direction and to the horizontal, a thickening wedge towards the medial side, and, in a toe area of the sole, between the midsole bottom and the sole bottom, the undersole forms, transverse to the walking direction and to the horizontal, a thickening wedge towards the lateral side, and the wedge-shaped configuration from the heel area to the toe area merges with a defined profile from one form into the other.

7. Diagonally twisted sole according to claim 1, wherein, in a heel area of the sole, between the midsole bottom and the sole bottom, the undersole forms, transverse to the walking direction and to the horizontal, a thickening wedge towards the lateral side, and, in a toe area of the sole, between the midsole bottom and the sole bottom, the undersole forms, transverse to the walking direction and to the horizontal, a thickening wedge towards the medial side, and the wedge-shaped configuration from the heel area to the toe area merges with a defined profile from one form to the other.

8. Diagonally twisted sole according to claim 2, wherein, in a heel area of the sole, between the midsole bottom and the sole bottom, the undersole forms, transverse to the walking direction and to the horizontal, a thickening wedge towards the medial side, and, in a toe area of the sole, between the midsole bottom and the sole bottom, the undersole forms, transverse to the walking direction and to the horizontal, a thickening wedge towards the lateral side, and the wedge-shaped configuration from the heel area to the toe area merges with a defined profile from one form into the other.

9. Diagonally twisted sole according to claim 5, wherein, in a heel area of the sole, between the midsole bottom and the sole bottom, the undersole forms, transverse to the walking direction and to the horizontal, a thickening wedge towards the medial side, and, in a toe area of the sole, between the midsole bottom and the sole bottom, the undersole forms, transverse to the walking direction and to the horizontal, a thickening wedge towards the lateral side, and the wedge-shaped configuration from the heel area to the toe area merges with a defined profile from one form into the other.

10. Diagonally twisted sole according to claim 2, wherein, in a heel area of the sole, between the midsole bottom and the sole bottom, the undersole forms, transverse to the walking direction and to the horizontal, a thickening wedge towards the lateral side, and, in a toe area of the sole, between the midsole bottom and the sole bottom, the undersole forms, transverse to the walking direction and to the horizontal, a thickening wedge towards the medial side, and the wedge-shaped configuration from the heel area to the toe area merges with a defined profile from one form to the other.

11. Diagonally twisted sole according to claim 5, wherein, in a heel area of the sole, between the midsole bottom and the sole bottom, the undersole forms, transverse to the walking direction and to the horizontal, a thickening wedge towards the lateral side, and, in a toe area of the sole, between the midsole bottom and the sole bottom, the undersole forms, transverse to the walking direction and to the horizontal, a thickening wedge towards the medial side, and the wedge-shaped configuration from the heel area to the toe area merges with a defined profile from one form to the other.

12. A shoe comprising a diagonally twisted sole according to claim 1.

* * * * *

UNITED STATES PATENT AND TRADEMARK OFFICE

CERTIFICATE OF CORRECTION

PATENT NO. : 8,146,269 B2
APPLICATION NO. : 10/585777
DATED : April 3, 2012
INVENTOR(S) : Jung-Suk Mueller It is certified that error appears in the above-identified patent and that said Letters Patent is hereby corrected as shown below:

On the Cover Page:

At field (73), "Negort AG, Roggwill (CH)" should be -- Masai Marketing & Trading AG, Romanshorn, Switzerland --.

Signed and Sealed this
Fourteenth Day of August, 2012

David J. Kappos

David J. Kappos
*Director of the United States Patent and Trademark Office*